US005491381A

United States Patent [19]

Idei et al.

[11] Patent Number: 5,491,381

[45] Date of Patent: Feb. 13, 1996

[54] DISCHARGE TUBE

[75] Inventors: Gijun Idei; Takuji Kinoshita; Kunio Hoshino, all of Shizuoka, Japan

[73] Assignee: Yazaki Corporation, Tokyo, Japan

[21] Appl. No.: 375,513

[22] Filed: Jan. 18, 1995

Related U.S. Application Data

[63] Continuation of Ser. No. 992,094, Dec. 17, 1992, abandoned.

[30] Foreign Application Priority Data

Dec. 18, 1991 [JP] Japan ..... 3-335257

[51] Int. Cl.[6] ..... H01T 2/02

[52] U.S. Cl. ..... 313/589; 313/634; 313/231.11

[58] Field of Search ..... 313/589, 631, 313/634, 603, 231.11; 337/28, 34; 361/120, 117

[56] References Cited

U.S. PATENT DOCUMENTS

| | | | |
|---|---|---|---|
| 3,253,177 | 5/1966 | Hamilton . | |
| 3,739,230 | 6/1973 | Lange | 361/120 |
| 3,876,894 | 4/1975 | Peche | 313/631 |
| 4,104,693 | 8/1978 | Toda et al. . | |
| 4,912,592 | 3/1990 | Flindall et al. | 361/120 |
| 4,924,347 | 5/1990 | Cantagrel | 361/120 |
| 5,103,135 | 4/1992 | Lange et al. | 361/120 |
| 5,243,257 | 9/1993 | Dietrich et al. | 313/634 |

FOREIGN PATENT DOCUMENTS

| | | |
|---|---|---|
| 2636167 | 3/1990 | France . |

*Primary Examiner*—Sandra L. O'Shea
*Assistant Examiner*—Vip Patel
*Attorney, Agent, or Firm*—Finnegan, Henderson, Farabow, Garrett & Dunner

[57] ABSTRACT

A discharge tube which assures stabilized discharging, is reduced in overall size and easy to manufacture is disclosed. The discharge tube comprises a cylindrical envelope made of an insulating substance, discharge gas enclosed in the envelope, and a pair of discharge electrodes disposed in an opposing relationship to each other at the opposite ends of the envelope. The the discharge electrodes are formed as parallel plate electrodes wherein faces thereof facing the inside of the envelope extend flat and in parallel to each other. A pair of conductive layers formed on the envelope in an opposing relationship to and electrically connected to the discharge electrodes, and one of the conductive layers is opposed at least part thereof with the other conductive layer with a portion of the envelope interposed therebetween.

12 Claims, 13 Drawing Sheets

DISCHARGE TUBE

This application is a continuation of application Ser. No. 07/992,094 filed Dec. 17, 1992, now abandoned.

BACKGROUND OF THE INVENTION

1. Field of the Invention

This invention relates to a discharge tube, and more particularly to a discharge tube which is improved in stability in discharging.

2. Description of the Prior Art

Conventionally, discharge tubes wherein discharge gas is enclosed in an insulator tube and a voltage is applied between a pair of electrodes sealed at the opposite end portions of the insulator tube to cause discharge in the insulator tube are employed widely in various technical fields.

Referring to FIG. 13, there is shown an exemplary one of conventional discharge tubes. The discharge tube 1 includes a cylindrical envelope 2 of an insulating substance such as ceramic. A pair of metal layers 3 are formed on the opposite end faces of the envelope 2 by suitable means such as metallization. A pair of electrode plates 4 are sealed in an opposing relationship to each other to the opposite end faces of the envelope 2 with the metal layers 3 interposed therebetween. The electrode plates 4 have electrodes 5 formed from central portions thereof which project like bars toward each other. Discharge gas such as argon gas is enclosed in the internal spacing of the envelope 2. Upon manufacture of the discharge tube 1, the discharge gas is introduced into the discharge tube 1 by way of an enclosure pipe 6 securely mounted on a left-hand side one in FIG. 13 of the electrodes 4 and an enclosure hole 7 formed in the adjacent electrode 5, whereafter the enclosure pipe 6 is closed. During use of the discharge tube 1, a predetermined sufficiently high voltage is applied between the electrode plates 4, and thereupon, discharge takes place in a discharge gap G between the inner opposing end portions of the electrodes 5.

In the conventional discharge tube 1, the bar-like electrodes 5 are positioned within the envelope 2, and the end portion of each of the electrodes 5 has a cross section of a generally semicircular shape as seen in FIG. 13. With the bar-like electrodes 5 of such configuration, the electric field around the surfaces thereof and in the discharge gap G is liable to become a non-uniform electric field which varies in intensity at various locations. Consequently, the starting voltage fluctuates significantly, for example, 20 to 30% respect to the average value thereof. Also the aging is great. Accordingly, the conventional discharge tube has a problem that discharge is not stable. It is another problem of the conventional discharge tube that, if a neighboring conductor having a certain potential is positioned in the proximity of the envelope 2 of the discharge tube 1, then the discharge tube 1 is influenced significantly by an electric field produced by the neighboring conductor so that the starting voltage of the discharge tube 1 is fluctuated significantly. The conventional discharge tube 1 has a further problem that, when a saw-tooth voltage is applied, the starting time is fluctuated by the saw-tooth voltage and discharge is not stabilized.

One of conventional solution to the problems is to form an electrode into a uniform electric field forming electrode which has a specific sectional shape at an end portion thereof such that the central portion thereof is formed as a flat face while a peripheral edge portion is formed as a curved face such as a Rogowski electrode, a Bruce electrode or a Harrison electrode so that the electric field around the surfaces of the electrodes and in the discharge gap is approximated to a uniform electric field in order to stabilize discharge.

However, in order to form an electrode into a uniform electric field forming electrode such as a Rogowski electrode, the electrode must have a large diameter equal to three to seven times the dimension of the discharge gap. This results in the drawback that the diametrical dimension of the entire discharge tube is very large. Further, such a uniform electric field forming electrode described above requires a precision working technique for surface working and so forth. Accordingly, there is another drawback that the manufacture of the uniform electric field forming electrode is very difficult and the production cost is very high.

Further, even if each electrode is formed into a uniform electric field forming electrode, since the entire electrodes are positioned in the inside of the envelope, if a little working error takes place in surface working, then the electric field becomes stronger at the location and discharge takes place from the portion. Accordingly, there is the possibility that discharge may be unstable.

SUMMARY OF THE INVENTION

It is an object of the present invention to provide a discharge tube which assures stabilized discharging, is reduced in overall size and easy to manufacture.

In order to attain the object described above, according to an aspect of the present invention, there is provided a discharge tube, which comprises a cylindrical envelope made of an insulating substance, discharge gas enclosed in the envelope, a pair of discharge electrodes disposed in an opposing relationship to each other at the opposite ends of the envelope, the discharge electrodes being formed as parallel plate electrodes wherein faces thereof facing the inside of the envelope extend flat and in parallel to each other, and a pair of conductive layers formed on the envelope in an opposing relationship to and electrically connected to the discharge electrodes, one of the conductive layers being opposed at least part thereof with the other conductive layer with a portion of the envelope interposed therebetween.

According to another aspect of the present invention, there is provided a discharge tube, which comprises a cylindrical envelope made of an insulating substance, discharge gas enclosed in the envelope, a pair of discharge electrodes disposed in an opposing relationship to each other at the opposite ends of the envelope, and a pair of conductive layers formed corresponding to the discharge electrodes at locations on the envelope which are on the outer side with respect to an inner wall face of the envelope and at least one of which is nearer than a position at which a corresponding one of the discharge electrodes contacts with an end portion of the envelope to the companion discharge electrode, the conductive layers being electrically connected to the respective corresponding discharge electrodes.

With the discharge tube, an electric field formed in the discharge gap between the opposing faces of the electrodes and another electric field formed in the envelope cooperate to form a uniform electric field. Consequently, the uniform electric field region formed in the discharge is very wide, and accordingly, discharge can be stabilized extremely.

Further, since the uniform electric field region is very wide, even where the discharge gap and the inner diameter of the discharge tube are substantially equal to each other, a uniform electric field can be formed in the entire discharge tube. Consequently, the diametrical dimension of the entire discharge tube can be reduced.

Furthermore, since a settled strong electric field which is close to a uniform electric field is formed in the envelope, the influence of a neighboring conductor is little, and discharge can be further stabilized. In addition, since the entire electrodes are not located in the inside of the envelope, a high working accuracy is not required and manufacture of the discharge tube is facilitated extremely.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
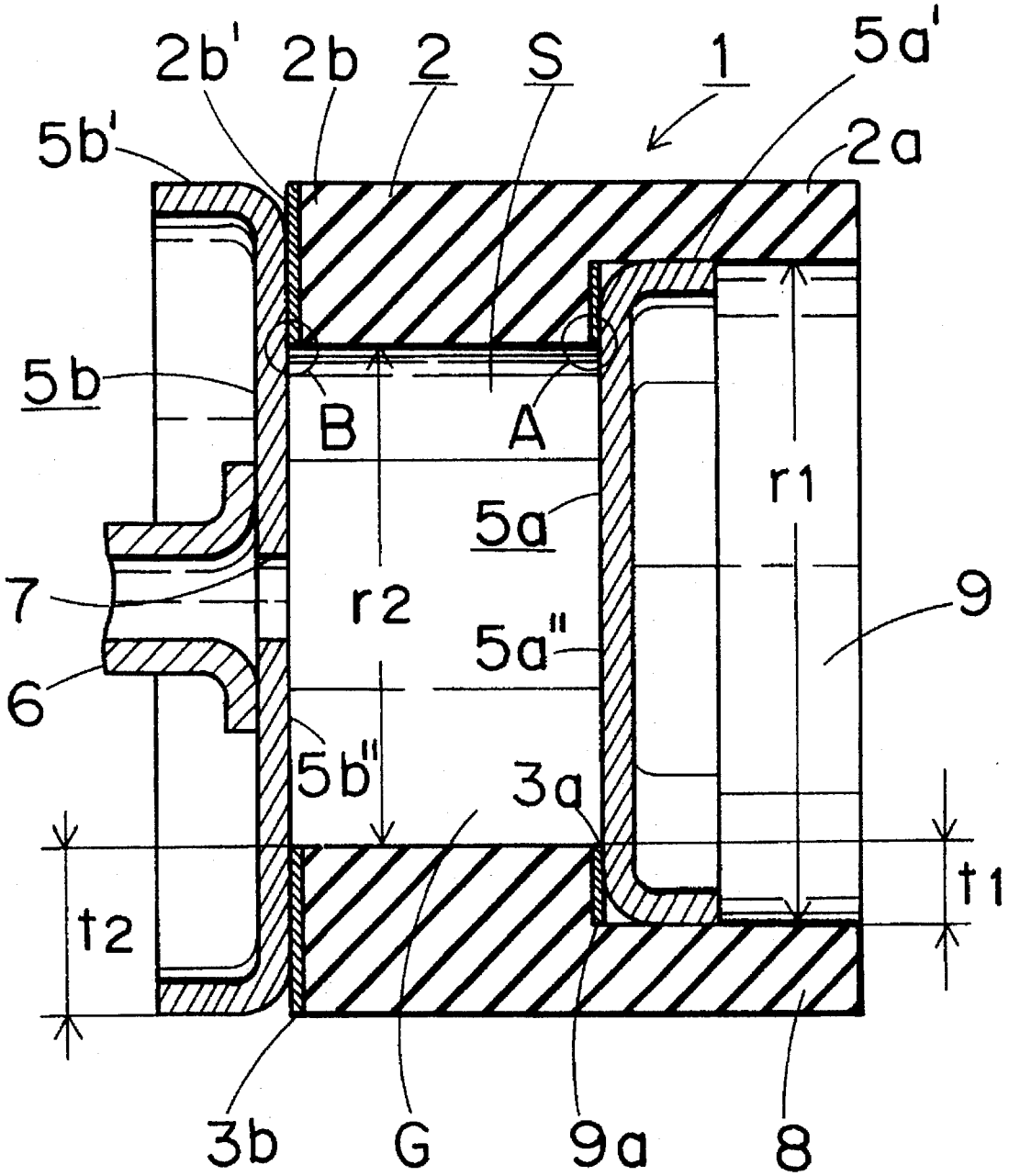
FIG. 1 is a sectional view of a discharge tube showing a first preferred embodiment of the present invention.
Figure 13:
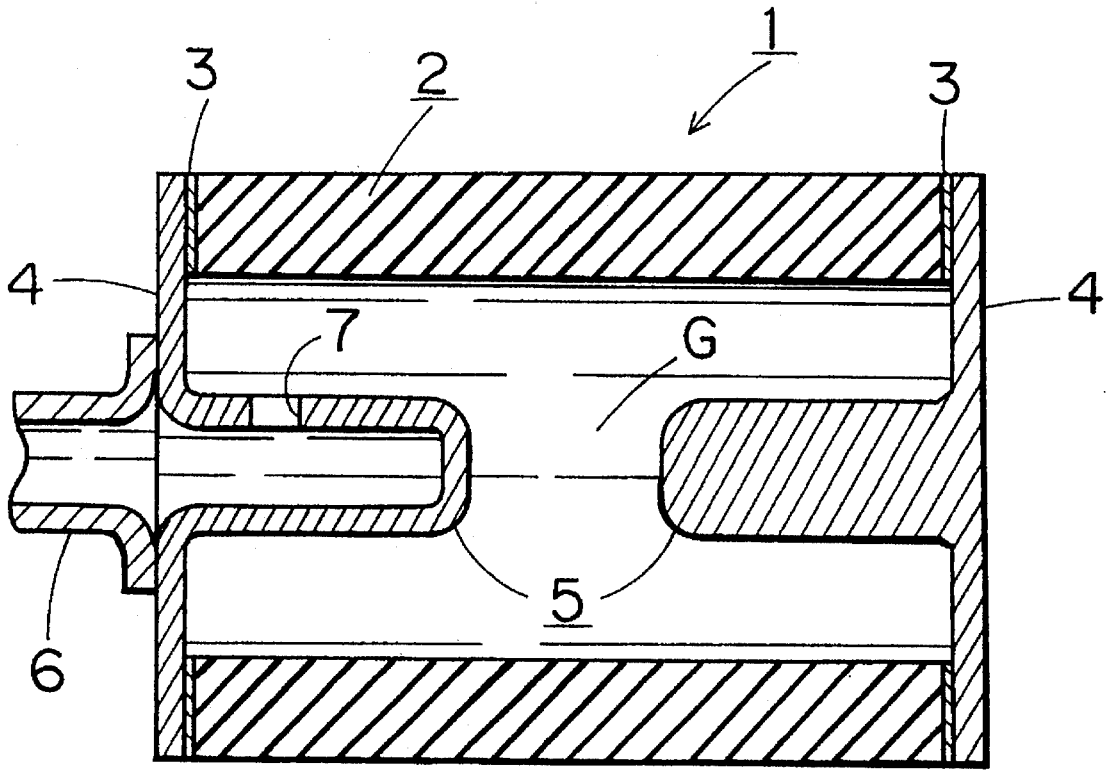
FIG. 13 PRIOR ART
FIG. 13 is a sectional view showing a conventional discharge tube.

Referring first to FIG. 1, there is shown a discharge tube to which the present invention is applied. The discharge tube is generally denoted at 1 and includes several elements which have basically similar functions as those of the elements of the conventional discharge tube shown in FIG. 13, and in FIG. 1, like elements having like functions are denoted by like reference characters to those of FIG. 13 and overlapping description thereof may be omitted herein. This similarly applies to the embodiments described hereinbelow. The discharge tube 1 shown in FIG. 1 includes a cylindrical envelope 2 made of an insulating substance such as ceramic. The envelope 2 has a stepped portion 8 formed in the inside thereof such that the inner diameter r1 at one end portion 2*a* thereof is larger than the inner diameter r2 of the other end portion 2*b* thereof. A mounting recess 9 is thus formed at the end portion 2*a* of the envelope 2 by the stepped portion 8. An electrode 5*a* is fitted in the mounting recess 9. The electrode 5*a* has a generally disk-like shape and has a peripheral portion 5*a'* formed in a curved shape such that it is rounded toward the entrance side of the mounting recess 9. The inner end face 9*a* of the mounting recess 9 is formed as a conductive face by a metal layer 3*a* formed by metallization or some other suitable means, and the peripheral portion 5*a'* of the electrode 5*a* fitted in the mounting recess 9 is sealed to the inner end face 9*a* by soldering or some other suitable means.

Also an outer end face 2*b'* of the other end portion 2*b* of the envelope 2 is formed as a conductive face by a metal layer 3*b* formed by metallization or some other suitable means, and a peripheral portion 5*b'* of another electrode 5*b* is sealed to the outer end face 2*b'* of the envelope 2. The electrode 5*b* has a generally disk-like profile and has a diameter substantially equal to the outer diameter of the envelop 2, and the peripheral portion 5*b'* thereof is rounded outwardly of the envelope 2. An enclosure pipe 6 is securely mounted at a central portion of the electrode 5*b* and an enclosure hole 7 is formed at a central portion of the electrode 5*b* so that predetermined discharge gas may be introduced into the discharge tube 1 by way of the enclosure pipe 6 and the enclosure hole 7.

In the present embodiment, the peripheral portions 5*a'* and 5*b'* of the electrodes 5*a* and 5*b* of the discharge tube 1 which have curved faces are sealed to the end faces 9*a* and 2*b'* of the envelope 2, respectively, and do not face the inside of the envelope 2, but only faces 5*a"* and 5*b"* of the electrodes 5*a* and 5*b*, which are substantially flat and extend parallel to each other, face the inside of the envelope 2. Consequently, when a predetermined voltage is applied between the electrodes 5*a* and 5*b*, the electric field formed in a discharge spacing S between the electrode faces 5*a"* and 5*b"* is approximated to a uniform electric field.

Further, the sealed portion 3*a* for one 5*a* of the electrodes 5*a* and 5*b* sealed to the opposite end portions of the envelope 2 is overlapped, as viewed from the left or right in FIG. 1, with the sealed portion 3*b* for the other electrode 5*b* over an area of a portion of the envelope 2 having a dimension t1 in a radial direction. Consequently, an electric field approximated to a uniform electric field is formed also in the portion of the envelope 2. Besides, the electric field formed in the envelope 2 here is substantially equivalent to an electric field which is formed by the electrodes which are expanded outwardly substantially by $\epsilon$t1 by conversion in terms of ordinary gas in the discharge tube where $\epsilon$ is a dielectric constant of the envelope.

The electric field formed between the electrode faces 5*a"* and 5*b"* and the electric field formed in the envelope 2 cooperate with each other so that they are formed continuously. Consequently, an electric field approximated closely to a uniform electric field is formed in the discharge spacing S by the electrode faces 5*a"* and 5*b"*, and discharge is stabilized significantly since the dispersion of the starting voltage of discharge which takes place in such discharge spacing S is reduced.

The drawback of the conventional discharge tube as described above is eliminated by the discharge tube of the present embodiment. In particular, since the electrode faces 5*a"* and 5*b"* of the electrodes 5*a* and 5*b* sealed to the opposite end portions of the envelope 2 which face the inside of the envelope 2 are formed as parallel plate electrode faces and the sealed portion 3*a* for one 5*a* of the electrodes 5*a* and 5*b* which serve as one of conductive faces of the envelope 2, to which the same potentials as to those of the electrodes 5*a* and 5*b* are applied, is overlapped with the sealed portion 3*b* for the other electrode 5*b* with a portion of the envelope 2 interposed therebetween, the electric field formed between the electrode faces 5*a*" and 5*b*" and the electric field formed in the envelope 2 cooperate with each other. Consequently, the discharge tube produces a very wide uniform electric field region, and discharge thereof is stabilized because the dispersion of the starting voltage is reduced.

Further, with the conventional uniform electric field forming electrode described hereinabove, a uniform electric field is formed only at a predetermined portion of the discharge gap but not formed in the entire discharge tube. Further, in order to form a uniform electric field at the predetermined portion, an electrode having a diameter equal to several times the dimension of the discharge gap, and consequently, the diametrical dimension of the entire discharge tube becomes very large. In contrast, with the discharge tube of the present embodiment, since the uniform electric field region is very wide, even where the discharge gap and the inner diameter of the discharge tube are substantially equal to each other, a uniform electric field can be formed in the entire discharge tube, and as a result, the diametrical dimension of the entire discharge tube can be reduced and the discharge tube can be reduced in size comparing with the conventional discharge tube. This means, in other words, that a large discharge gap can be obtained with a limited outer diameter of the discharge tube.

Further, since the discharge tube is formed such that the electric field formed in the envelope 2 is close to a uniform electric field and the uniform electric field region is made very wide making use of the strong electric field, the influence of a neighboring conductor positioned on the outside of the discharge tube 1 is reduced. Consequently, the dispersion of the starting voltage arising from such neighboring conductor can be minimized.

Furthermore, since the curved peripheral portions 5*a*' and 5*b*' of the electrodes 5*a* and 5*b* do not face the inside of the envelope 2, the working accuracy of such curved portions does not matter at all. Consequently, the manufacture of the electrodes is facilitated very much. Further, since it is only necessary to seal such electrodes 5*a* and 5*b* to the envelope 2 having the stepped portion 8 on the inner periphery thereof to assemble them, the production cost of the discharge tube can be suppressed very low.

Further, since the electrode 5*a* is fitted in the mounting recess 9 formed in the envelope 2, the distance from the electrode 5*a* to the other electrode 5*b* along the outer wall face of the envelope 2 is increased. Consequently, occurrence of creeping discharge along the outer face of the envelope 2 can be minimized or prevented and discharge can take place with a sufficiently high starting voltage between the electrode faces 5*a*" and 5*b*".

Here, in the present embodiment, a measurement was conducted with a discharge tube manufactured actually wherein the envelope 2 is made of alumina ceramic, the thickness t2 of material is 2 mm, the inner diameter r2 is 20 mm, the thickness t1 of the stepped portion 8 is 1 mm, the electrode gap G between the electrode faces 5*a*" and 5*b*" is 6 mm, the discharge gas enclosed in the discharge tube 1 is argon gas and the pressure of the discharge gas is 6 kg/cm$^2$. The measurement proved that the average value of the starting voltage is 20 kv and the difference between the highest value and the lowest value of the starting voltage is 4.3% with respect to the average value. Thus, discharge is stabilized very much. Further, it was proved that, even if nitrogen gas is enclosed as the discharge gas, the dispersion of the starting electrode is small.

It is to be noted that, if the voltage of the discharge tube 1 at which external creeping discharge described above takes place is lower than the starting voltage, then the electrode 5*a* need not be fitted in the mounting recess 9 of the envelope 2 as described above, but it is only necessary to merely seal the electrode 5*a* to the end face of the envelope 2 like the other electrode 5*b* described above.

Further, while the entire metallization layers or conductive faces 3*a* and 3*b* are described as sealed portions of the electrodes 5*a* and 5*b*, since it is only necessary that the conductive faces 3*a* and 3*b* have a function of forming an electric field in the envelope 2, sealing of the electrodes 5*a* and 5*b* may be performed at part of the conductive faces or may be performed at some other portions than the conductive faces by some other means.

Figure 2:
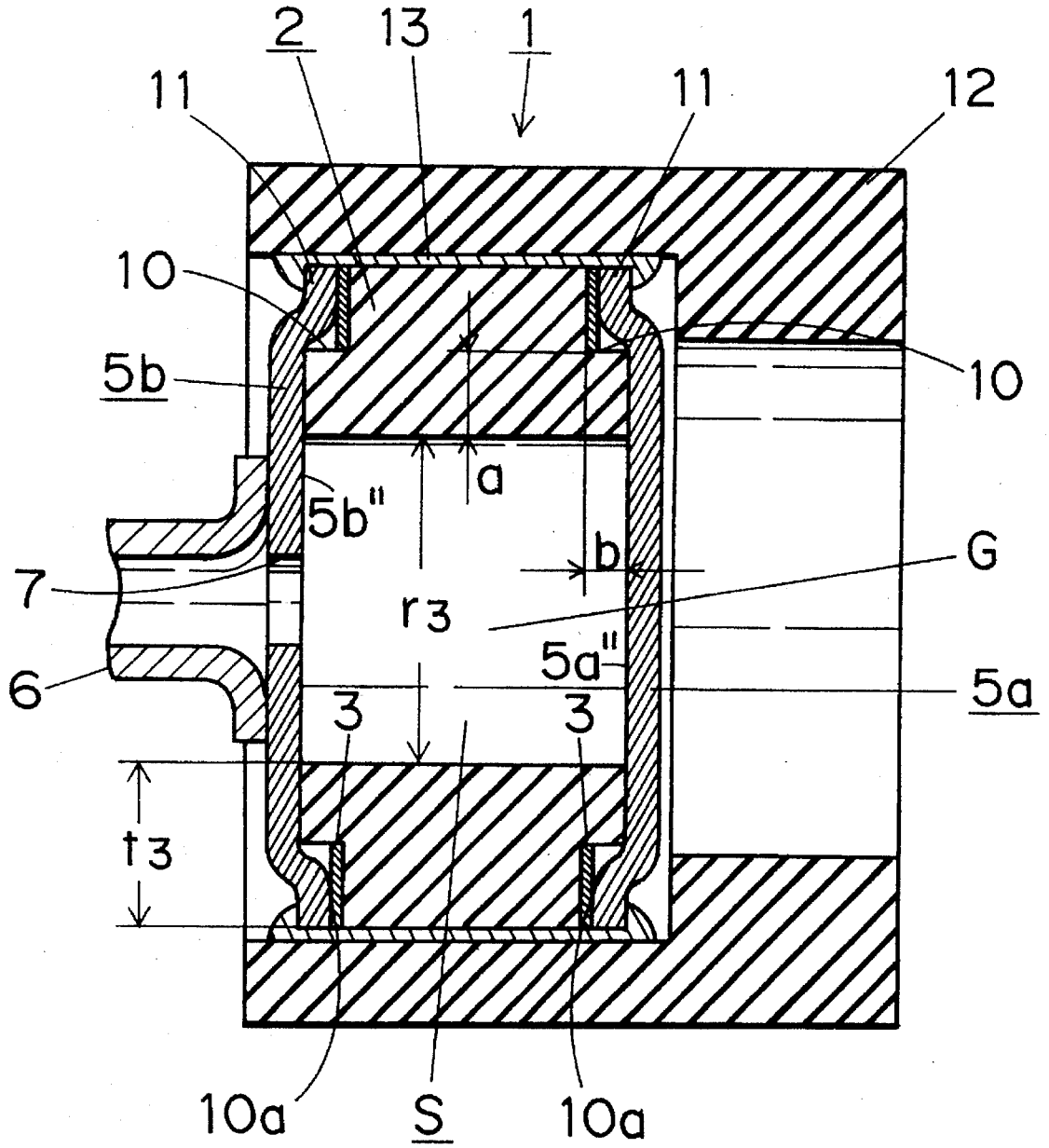
FIG. 2 is a sectional view of another discharge tube showing a second preferred embodiment of the present invention.

Referring now to FIG. 2, there is shown a discharge tube according to a second embodiment of the present invention. The present discharge tube 1 is a modification or improvement to the discharge tube 1 of the first embodiment of FIG. 1.

An experiment was conducted with the discharge tube 1 which was assembled such that the envelope 2 of the discharge tube 1 shown in FIG. 1 was formed from Pyrex glass. The experiment proved that discharge sometimes takes place at such locations as indicated A and B in FIG. 9 at which the inner wall of the envelope 2 and the electrodes 5*a* and 5*b* contact with each other, and the electric field is stronger at or around the location.

The drawback is eliminated by the discharge tube 1 of the present embodiment. In particular, referring to FIG. 2, a pair of annular recesses 10 are formed at peripheral edge portions at the opposite axial ends of a cylindrical envelope 2, and a metal layer 3 is formed on an end face 10*a* of each recess 10 as a conductive face by suitable means such as metallization. A pair of electrodes 5*a* and 5*b* are disposed in an opposing relationship to each other at the opposite ends of the envelope 2 and are each formed substantially as a disk having a diameter substantially equal to the envelope 2. Peripheral flanged portions 11 of the electrodes 5*a* and 5*b* are sealed to the metallized end faces 10*a* of the recesses 10. The envelope 2 having the electrodes 5*a* and 5*b* sealed to the opposite end portions thereof is accommodated in and secured to the inside of a creeping discharge preventing tube 12 by way of a predetermined bonding agent 13. It is to be noted that reference numeral 6 denotes an enclosure pipe for discharge gas.

In the present embodiment, since the conductive faces provided by the metallization layers 3 between the envelope 2 and the electrodes 5*a* and 5*b* and serving as the sealed portions are positioned at the outer peripheral portions of the envelope 2 and do not face the inside of the envelope 2, the electric field is weakened at locations at which the inner wall of the envelope 2 and the electrodes 5*a* and 5*b* contact with each other. Consequently, the occurrence of discharge at the locations can be prevented and further stabilized discharge can be obtained.

Further, while a discharge tube having a very wide uniform electric field region is obtained making use of an electric field formed between faces 5*a*" and 5*b*" of the electrodes 5*a* and 5*b* and another electric field formed in the envelope 2 as described above, generally the electric field formed in the envelope 2 is a little weaker than the electric field formed between the electrodes 5*a*" and 5*b*" due to a difference between the electric field substances so that the equipotential surface formed in the envelope 2 tends to be inclined a little from the center to the opposite end sides of the discharge tube. However, according to the present embodiment, since the electrodes 5*a* and 5*b* are sealed to the recessed end faces 10*a* of the envelope 2, the conductive faces of the envelope 2 to which potentials are applied from the electrodes 5*a* and 5*b* are disposed nearer to the companion electrode sides than the electrode faces 5*a*" and 5*b*". Accordingly, it is possible to correct distortion of the electric field in the envelope 2 described above so that the equipotential surfaces of the electric fields formed between the electrode faces 5*a*" and 5*b*" and in the envelope 2 may be free from distortion, and the electric field formed in the discharge tube can be made further close to a uniform electric field and discharge can be further stabilized.

Here, the relationship between the locations of the conductive faces, that is, a portion a and another portion b in FIG. 2, is given, where the dielectric constant of the envelope 2 is represented by $\epsilon$ and the proportional constant by K, from various experiments, by $$b=K\cdot a/\epsilon$$

and it has been cleared up that K ranges from 1 to 3 as an optimum value.

A measurement was conducted with the discharge tube wherein the envelope 2 is made of alumina ceramic, the thickness t3 of material is 2 mm, the inner diameter r3 is 6 mm, the dimension of the portion a is 1 mm, the dimension of the portion b is 0.2 mm, the electrode gap G is 6 mm, and the pressure of argon gas enclosed is 6 kg/cm$^2$. The measurement proved that the average value of the starting voltage is 20 kv and the difference between the highest value and the lowest value of the starting voltage is 4.0% or so with respect to the average value. Thus, discharge is stabilized. Further, it was proved that, even if nitrogen gas is enclosed as the discharge gas, the dispersion of the starting electrode is small.

It is to be noted that, while, as described hereinabove, the electrodes 5*a* and 5*b* are sealed to the recessed end faces 10*a* of the envelope 2 as described above and the positions of the conductive faces and the sealed portions of the electrodes coincide with each other, if the recessed end faces 10*a* function as the conductive faces, then the sealed portions of the electrodes 5*a* and 5*b* to the envelope 2 may be at locations other than the recessed end faces 10*a* within the range in which the sealed portions by metallization do not face the inside of the envelope 2. In this instance, the metallization faces as the conductive faces need not be parallel to each other, and for example, they may be, for example, in the form of application to the outer wall of the envelope 2.

Further, the creeping discharge preventing tube 12 need not be made of an insulating substance such as ceramic but may be made of plastic which is inexpensive, and if the voltage which causes external creeping discharge of the envelope 2 is higher than the starting voltage of the original discharge tube, the creeping discharge preventing tube 12 need not be employed.

Figure 3:
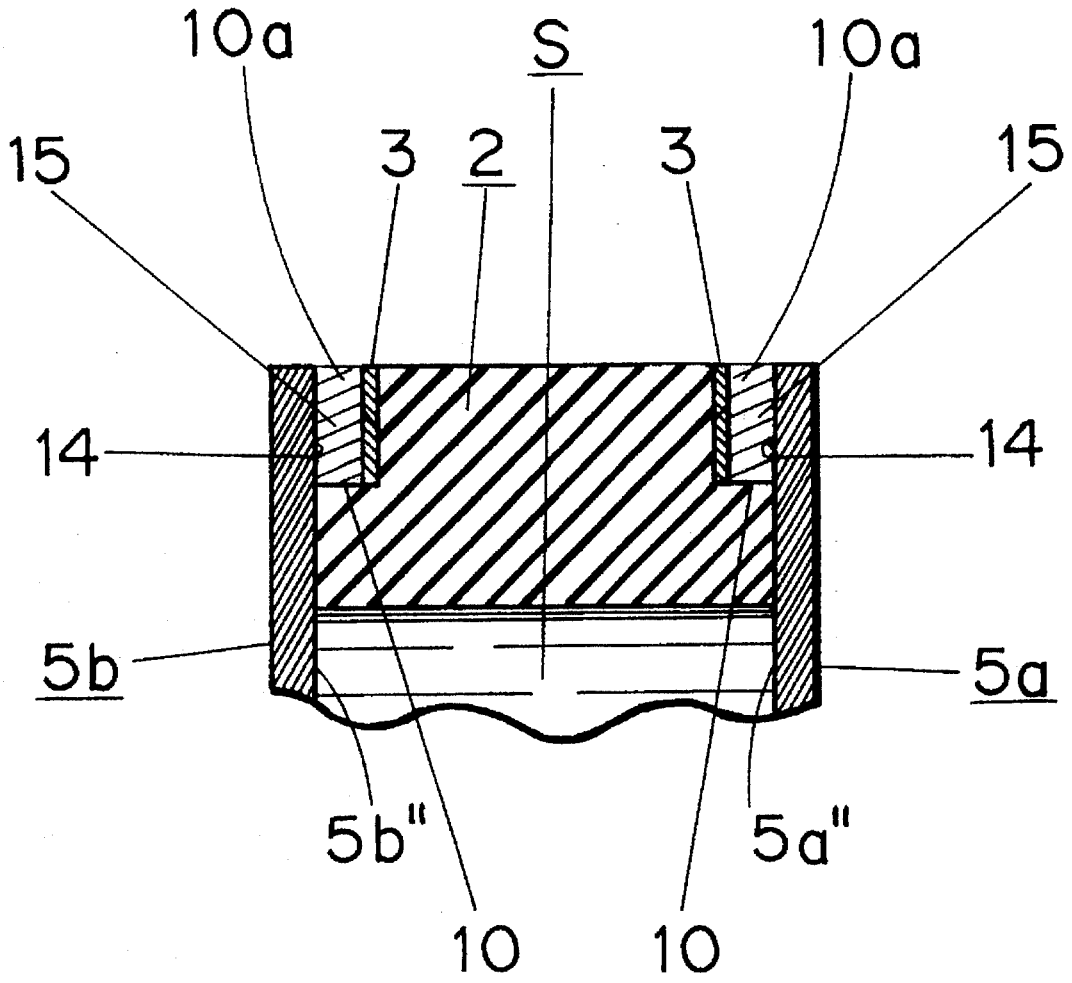
FIG. 3 is a partial sectional view showing a modification to the discharge tube shown in FIG. 2.

FIG. 3 shows a modification to the discharge tube 2 shown in FIG. 2, and since, as described above, the dimension of the portion b of the envelope 2 in FIG. 2 is 0.2 mm and very small and the recessed portion 10 is formed very small and besides the curve shapes of the peripheral edge flange portions 11 of the electrodes 5*a* and 5*b* sealed to such recessed end faces 10*a* are very small in curvature, the electrodes 5*a* and 5*b* are each formed in a mere flat disk shape without forming the peripheral edge flange portion 11 and a soldering material 15 such as silver solder is interposed between an electrode face 14 of each of such electrodes 5*a* and 5*b* and the opposing metallized recessed end face 10*a* .

With the construction, the dimension of the portion b of the envelope 2 can be absorbed by a soldering margin of the soldering material 15, and the production cost of such electrodes can be further suppressed by using flat plates in the form of mere disks as the electrodes 5*a* and 5*b*.

Figure 4:
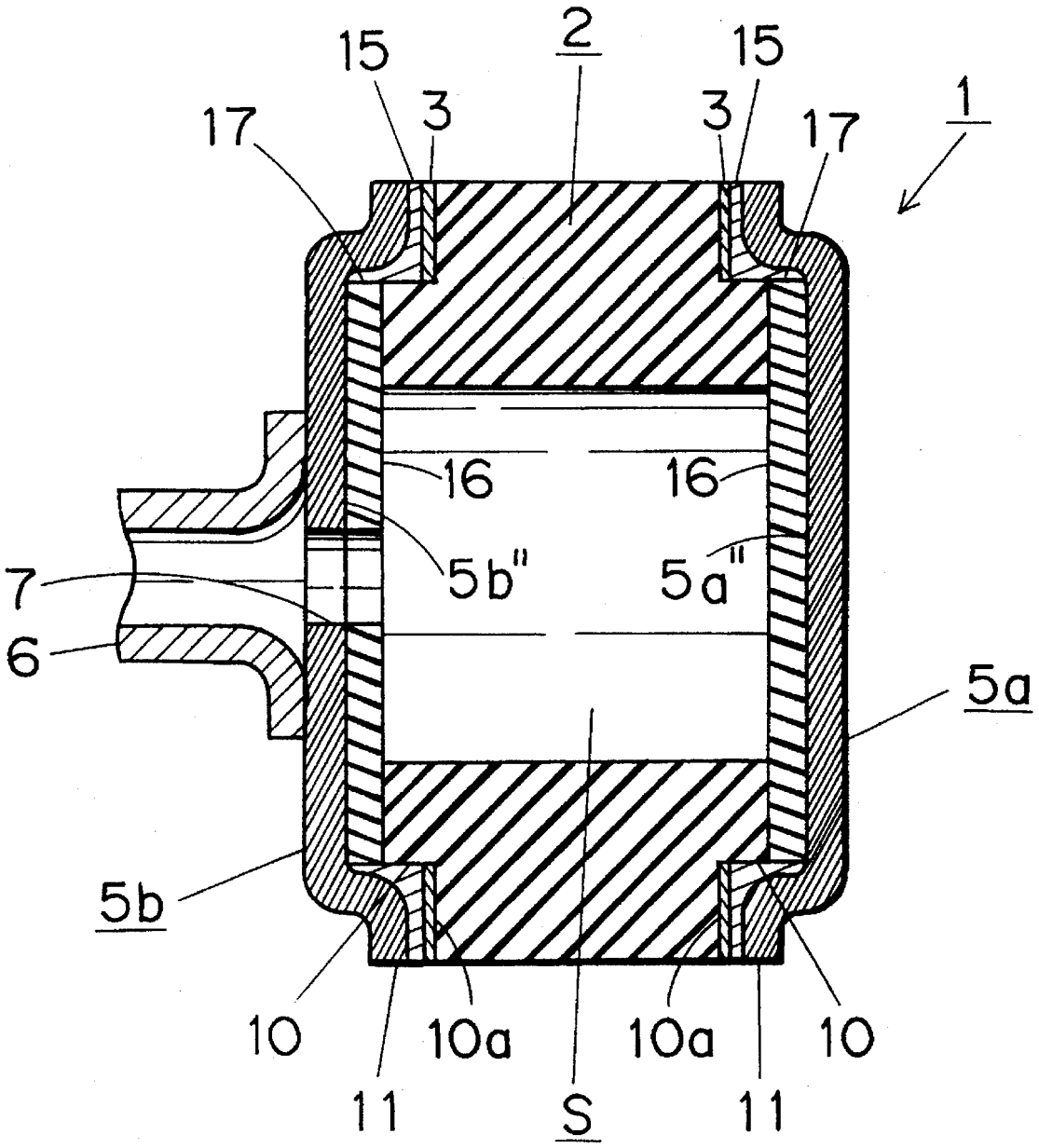
FIG. 4 is a sectional view of a further discharge tube showing a third preferred embodiment of the present invention.

Referring now to FIG. 4, there is shown a discharge tube according to a further embodiment of the present invention. The discharge tube of the present embodiment is a modification to the discharge tube 1 shown in FIG. 2 in that a pair of sputtering preventing plates 16 made of a high melting point metal such as tungsten, molybdenum or tantalum are interposed between the electrodes 5*a* and 5*b* seated to the opposite end portions of the envelope 2 and the opposite axial end faces of the envelope 2 such that the surfaces (electrode faces 5*a*" and 5*b*") of the electrodes 5*a* and 5*b* facing the inside of the envelope 2 are covered with the sputtering preventing plates 16. It is to be noted that the creeping discharge preventing tube 12 is not shown in FIG. 4.

Here, the sputtering preventing plates 16 are securely mounted at central portions of the electrodes 5*a* and 5*b*, which are formed from a material such as a 42 alloy, by welding or like means in order to the coefficient of thermal expansion of the sputtering preventing plates 16 equal to that of the envelope 2 which is made of ceramic or a like material. A small gap 17 is provided around a peripheral edge of each of the sputtering preventing plates 16 in order to allow expansion and contraction of the sputtering preventing plate 16.

Accordingly, in the discharge tube of the present embodiment, sputtering of that one of the electrodes 5*a* and 5*b* which serves as an anode can be prevented by the sputtering preventing plate 16, and consequently, soiling to the inner face of the envelope 2 arising from sputtering of the anode and occurrence of internal creeping discharge of the discharge tube arising from such soil can be prevented. Thus, the durability of the discharge tube can be enhanced and discharge can be further stabilized.

It is to be noted that the sputtering preventing plates 16 need not necessarily be provided for both of the electrodes 5*a* and 5*b*, and sufficient effects can be obtained otherwise if a sputtering preventing plate is provided for that one of the electrodes which serves as an anode.

Figure 5:
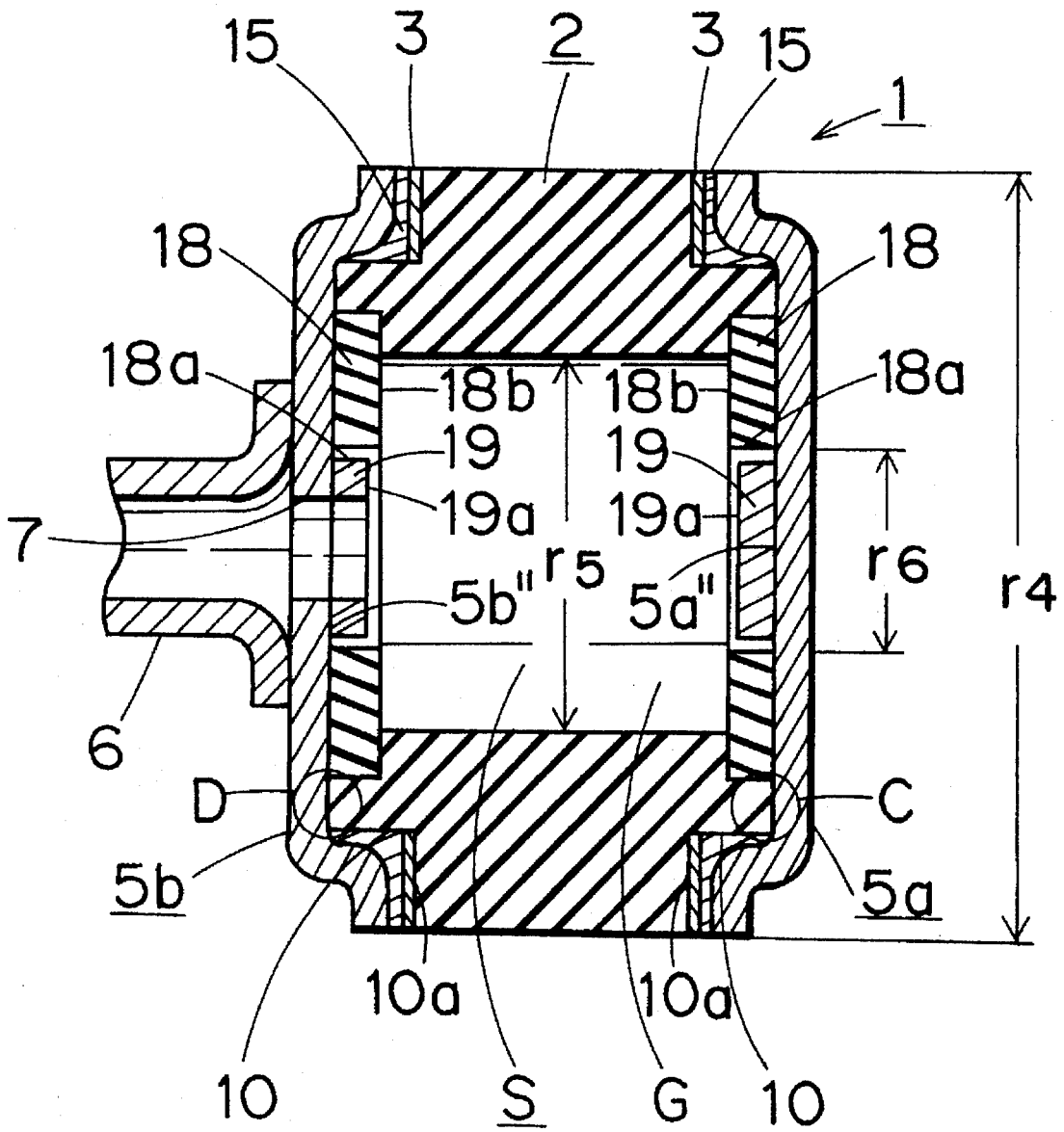
FIG. 5 is a similar view of a still further discharge tube showing a fourth preferred embodiment of the present invention.
Figure 6:
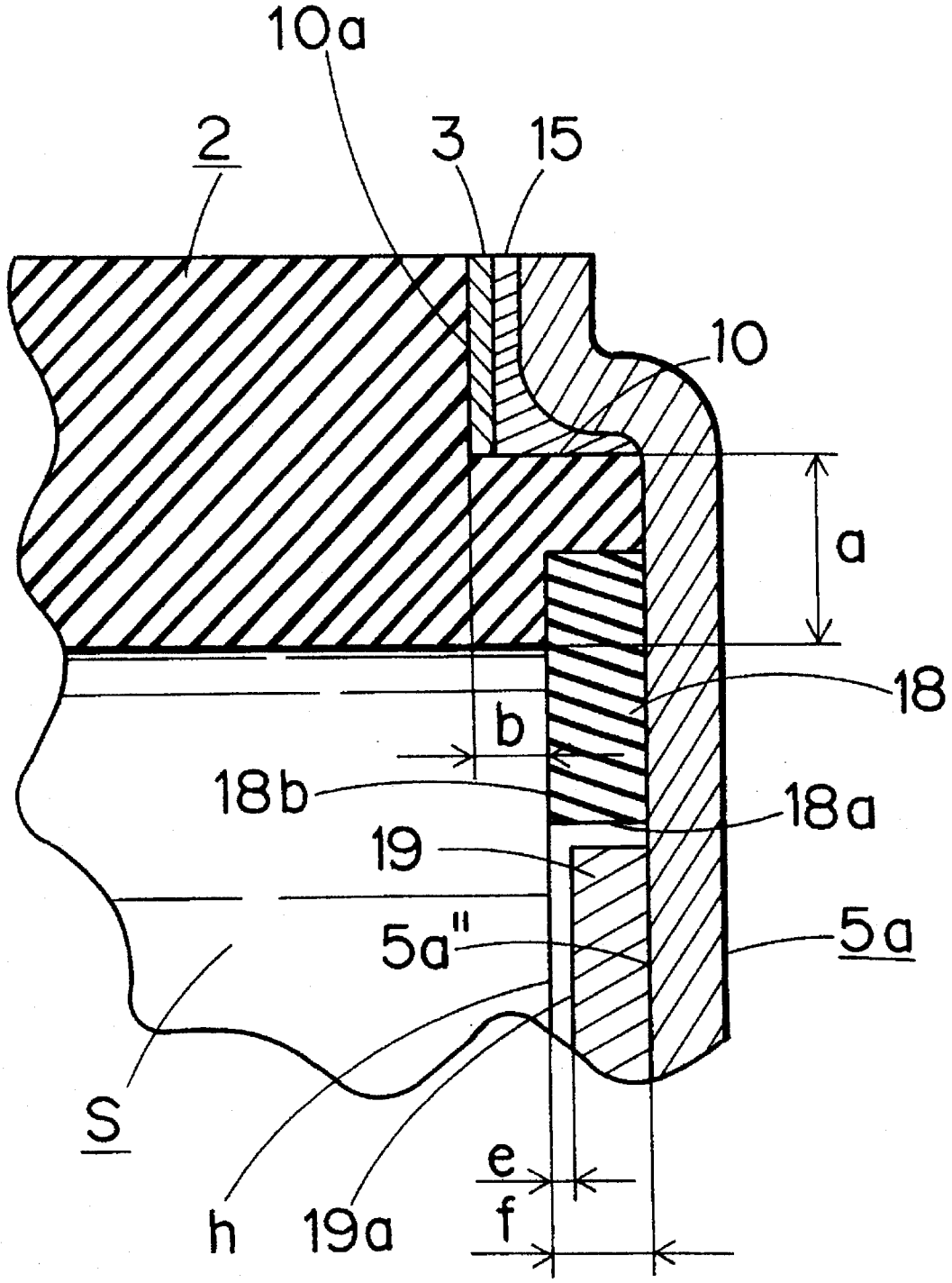
FIG. 6 is an enlarged partial sectional view of the discharge tube shown in FIG. 5.

Referring now to FIGS. 5 and 6, there is shown a discharge tube according to a still further embodiment of the present invention. The discharge tube of the present embodiment is a modification to the discharge tube 1 of the embodiment shown in FIG. 2 in that a projecting element 18 in the form of a washer formed from an insulating substance such as ceramic similar to that of the envelope 2 and having an opening 18*a* at the center thereof is securely mounted at an inner peripheral portion at each of the opposite axial ends of the envelope 2 by means of a glass frit seal or the like. Further, a conductive face 3 in the form of a metal layer formed by suitable means such as metallization is formed at the recessed end face 10*a* of an outer peripheral portion of each of the opposite ends of the envelope 2 so that the electrodes 5*a* and 5*b* may be sealed to the locations. Further, the surfaces (electrode faces 5*a*" and 5*b*") of the electrodes 5*a* and 5*b* face the inside of the envelope 2 by way of the openings 18*a* of the projecting elements 18, and at such locations, a pair of sputter preventing plates 19 are disposed and securely mounted in such a manner as to cover over the electrode faces 5*a*" and 5*b*". It is to be noted that the creeping discharge preventing tube 12 is not shown also in FIGS. 5 and 6.

Here, inner end faces 19*a* of the sputtering preventing plates 19 are positioned outwardly of the inner end faces 18*b* of the projecting elements 18 such that the sputtering preventing plates 19 are surrounded by the projecting elements 18. Further, the recessed end faces 10*a* as the conduct faces are positioned inwardly of the inner end faces 18*b* of the projecting elements 18. It was proved from various experiments that, when the dimensional relationships among various portions in FIG. 6 satisfy, where the dielectric constant of the projecting elements 18 is represented by $\epsilon 1$ and the dielectric constant of the envelope 2 by $\epsilon 2$, the following equations:

$$e=f/\epsilon 1$$

$$b=K\cdot a/\epsilon \text{ where } K=1 \text{ to } 3$$

the electric field at a plane h extended from the inner end face 18*b* of the projecting element 18*b* is uniform and close to a uniform electric field and the dispersion of the starting voltage is small.

Further, in discharge tube of the present embodiment, since the sputtering plate 19 which functions as an electrode is surrounded by the projecting element 18 and accordingly is surrounded by an electric field formed by the projecting element 18, the electric field formed by such projecting element 18 becomes a uniform electric field, and accordingly, the dispersion of the starting voltage can be reduced. Then, it has been cleared up that there is no problem even if the shape of the surface of the sputtering preventing plate 19 is not a flat shape. Further, the working accuracy of the sputtering preventing plate 19 is sufficient even if it is not very high, and it has been cleared up that, if the peripheral edge portion of the sputtering preventing plate 19 is chamfered, then the dispersion of starting voltage can be further reduced and the discharge maintaining voltage can be reduced.

Further, since the discharge route does not extend over the inner bore of the discharge tube and is limited to the positions around the sputtering preventing plates 19 positioned at the openings 18*a* of the projecting elements 18, discharge can be further stabilized, and since the sputtering preventing plates 18 have a small diameter, the cost of the sputtering preventing plates 19 can be suppressed.

Furthermore, the internal creeping distance of the discharge tube 1 is elongated by the projecting elements 18, and accordingly, occurrence of inner creeping discharge can be suppressed to further stabilize discharge.

Here, in the discharge tube of the present embodiment, a measurement was conducted with the discharge tube wherein the envelope 2 is made of alumina ceramic having a dielectric constant of about 9, the outer diameter r4 of the envelope 2 is 10 mm, the inner diameter r5 is 6 mm, the dimension of the portion a in FIG. 6 is 1 mm, the dimension of the portion b is 0.2 mm, the dimension of the portion e is 0.1 mm and the dimension of the portion f is 0.5 mm, the discharge gap G between the sputtering preventing plates 19 which function as electrodes is 6 mm, the diameter r6 of the openings 18*a* of the projecting elements 18 is 2 mm, and the pressure of argon gas enclosed is 6 kg/cm$^2$. The measurement proved that the average value of the starting voltage is 20 kv and the difference between the highest value and the lowest value of the starting voltage is 3.4% or so with respect to the average value. Accordingly, discharge is stabilized remarkably.

It is to be noted that, while, in the discharge tube of the embodiment described above, the conductive faces 3 are provided nearer to the companion electrodes than the inner end faces 8*b* of the projecting elements 18, this indicates an optimum condition, and it has been cleared up that, only if the conductive faces 3 are provided nearer to the companion electrodes than locations at which the electrodes 5 contact with the projecting elements 18 or the envelope 2, then the effect of making the electric field in the discharge spacing S close to a uniform electric field can be exhibited sufficient1y.

Further, it has been cleared up that sufficient effects can be obtained otherwise by provision of a projecting element 18 and a sputtering preventing plate 19 surrounded by the projecting element 18 only on one of the electrodes which serves as an anode.

Further, while the electrodes 5*a* and 5*b* are described as sealed to the conductive faces 3 provided at the recessed end faces 10*a* in the embodiment described above, since the conductive surfaces 3 are only required so that potentials to the electrodes 5 are applied to them so that they have an action of forming an electric field close to a uniform electric field in the envelope 2, sealing of the electrodes 5 may be performed at some other portions than the recessed end faces 10*a* such as, for example, at end portions as indicated by C or D shown in FIG. 5 for which metallization is performed.

Figure 7:
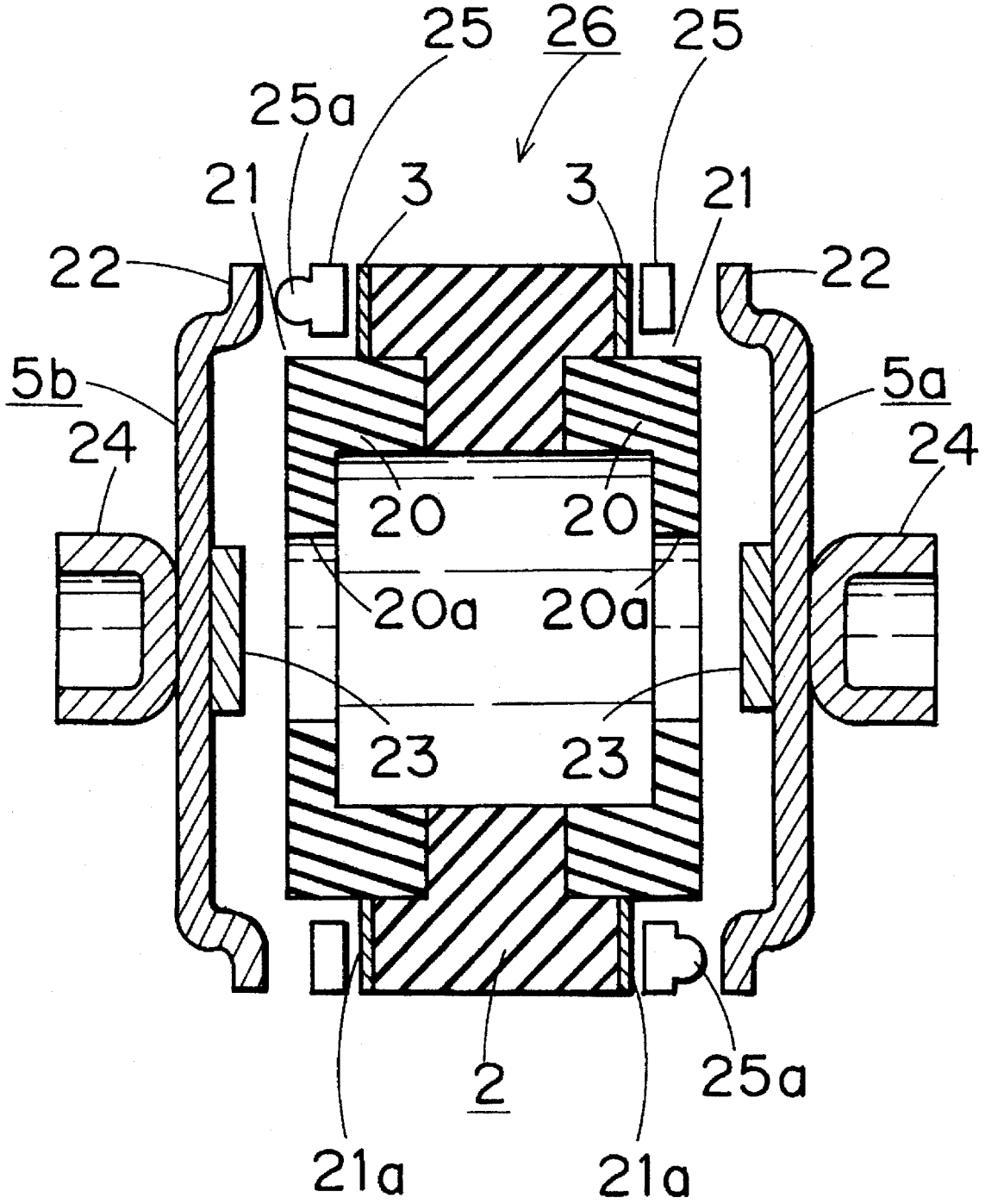
FIG. 7 is a sectional view of a yet further discharge tube before assembly showing a fifth preferred embodiment of the present invention.
Figure 8:
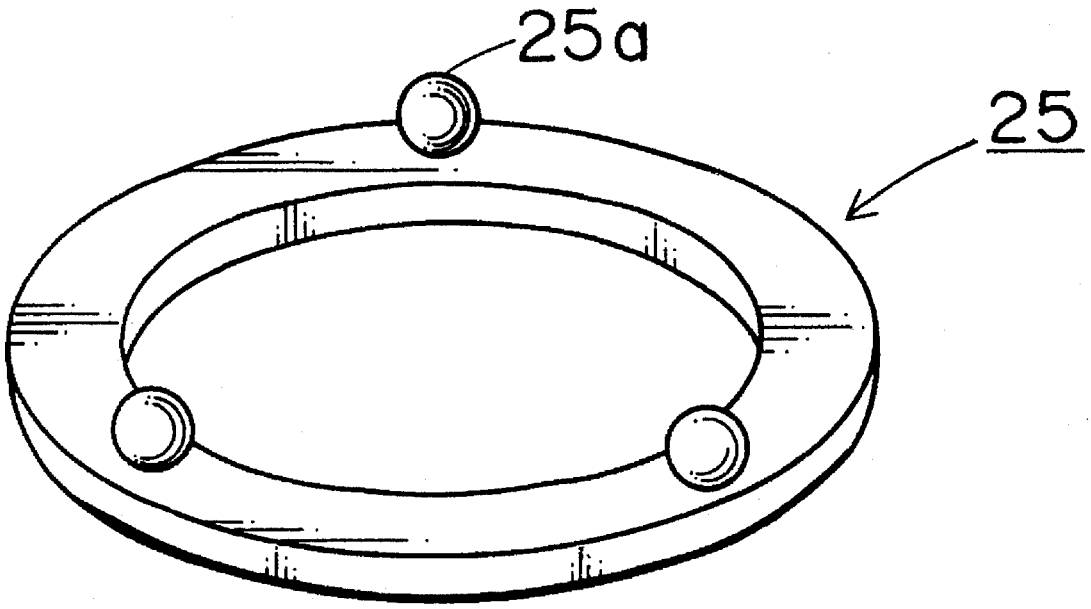
FIG. 8 is a perspective view of a solder material employed in the discharge tube shown in FIG. 7.
Figure 9:
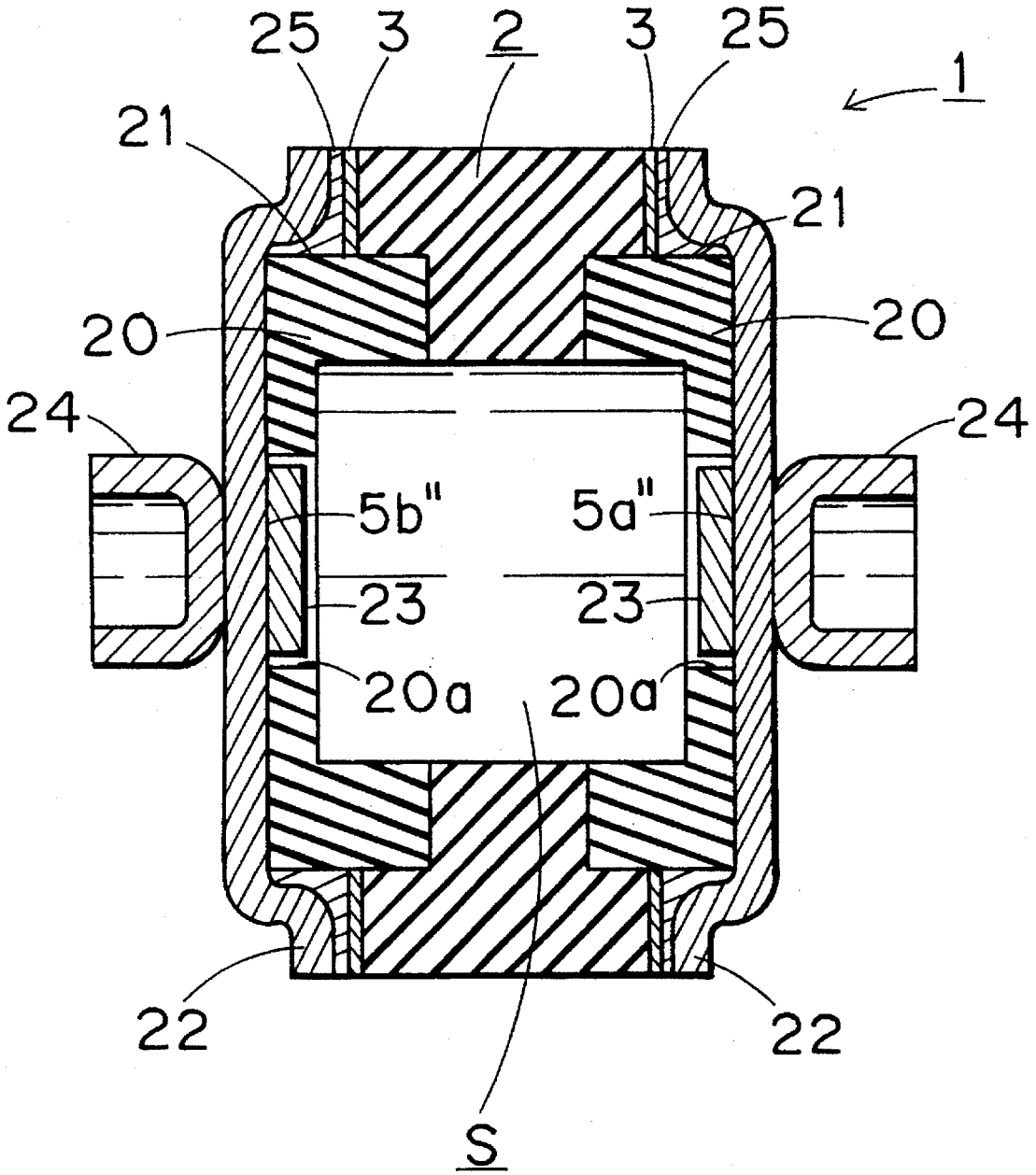
FIG. 9 is a sectional view showing the discharge tube of FIG. 7 in an assembled form.

Referring now to FIGS. 7 to 9, there is shown a discharge tube according to a yet further embodiment of the present invention. In the discharge tube of the present embodiment, discharge gas is introduced into the discharge tube 1 without using an enclosure pipe.

In particular, a pair of projecting elements 20 formed from an insulating substance such as ceramic similar to that of an envelope 2 and each having an opening 20*a* at the center thereof are securely mounted in advance at inner peripheral portions at the opposite axial ends of the substantially cylindrical envelope 2 each by means of a glass frit seal or the like so that a pair of recessed portions 21 are formed at the opposite end portions of the envelope 2 having the projecting elements 20. Further, a pair of substantially dish-like electrodes 5*a* and 5*b* are provided separately from the envelope 2 having the projecting elements 20. The electrodes 5*a* and 5*b* have formed thereon peripheral flange portions 22 which have a substantially equal diameter to that of the envelope 2 and are positioned at the recessed portions 21 when the discharge tube 1 is assembled as hereinafter described. A pair of sputtering preventing plates 23 are securely mounted in advance at central portions of faces of the electrodes 5*a* and 5*b* which make inner faces of the discharge tube when the discharge tube is assembled such that they may be positioned in the openings 20*a* of the projecting elements 20 while connecting portions 24 for communicating with the outside are securely mounted at central portions of faces which make outer faces of the discharge tube.

Further, end faces 21*a* of the recessed portions 21 serve as conductive faces in the form of metal layers formed by suitable means such as metallization, and such a ring-shaped solder material 25 having three protruded portions 25*a* formed in an equidistantly spaced relationship on one face thereof as shown in FIG. 8 is disposed in each of the recessed portions 21 such that a face thereof on which the protruded portions 25*a* are not formed is opposed to the corresponding metallized end face 21*a*.

In the discharge tube of the present embodiment, the electrodes 5*a* and 5*b* having the sputtering preventing plates 23 and the connecting portions 24 are disposed at the opposite end portions of the envelope 2 which has the projecting elements 20 formed in advance thereon, with the solder materials 25 interposed between them, and a weight is placed at an upper end portion of the envelope in a condition in which the arrangement shown in FIG. 7 is rotated by 90° by means of a jig not shown. Then, in a condition wherein they are assembled in the shape of the discharge tube 1, the entire assembly 26 is accommodated into a vessel of a gas exhausting and filling apparatus not shown, and degasification and exhaustion of air are performed while heating the assembly 26 to a sufficiently high temperature at which the solder materials 25 are not melted.

Here, small gaps are formed between the envelope 2 and the electrodes 5*a* and 5*b* by the protruded portions 25*a* of the solder materials 25 in the assembly 26, and the exhaustion of air is performed by way of the gaps. After the exhaustion of air is completed, discharge gas such as argon gas is filled under a predetermined pressure into the vessel of the gas exhausting and filling apparatus. Further, the vessel is heated to heat the entire assembly 26 to melt the solder material 25. Thereafter, the entire assembly 26 is gradually cooled so that such a discharge tube 1 as shown in FIG. 9 which contains discharge gas such as argon gas enclosed therein is formed.

Accordingly, in the present embodiment, discharge is stabilized and the manufacture and assembly of the discharge tube is facilitated by approximating the electric field between the electrodes 5*a* and 5*b* to a uniform electric field similarly to the embodiments described above. Further, sputtering can be prevented by the sputtering preventing plates 23 so that soiling to the inner face of the envelope 2 arising from sputtering at the anode and occurrence of internal creeping discharge of the discharge tube 1 arising from the soil is prevented or minimized, and besides, the internal creeping distance of the discharge tube 1 is elongated by the projecting elements 20 on the inner peripheral portions of the envelope 2 and occurrence of internal creeping discharge can be suppressed or reduced. Furthermore, since the sputtering preventing plates 23 are formed so that they can be disposed in the openings 20*a* of the projecting elements 20, the sputtering preventing plates 23 can be formed with a small diameter, and the cost of the sputtering preventing plates 23 can be suppressed. In addition, since no enclosure pipe is required, the cost can be suppressed as much.

Figure 10:
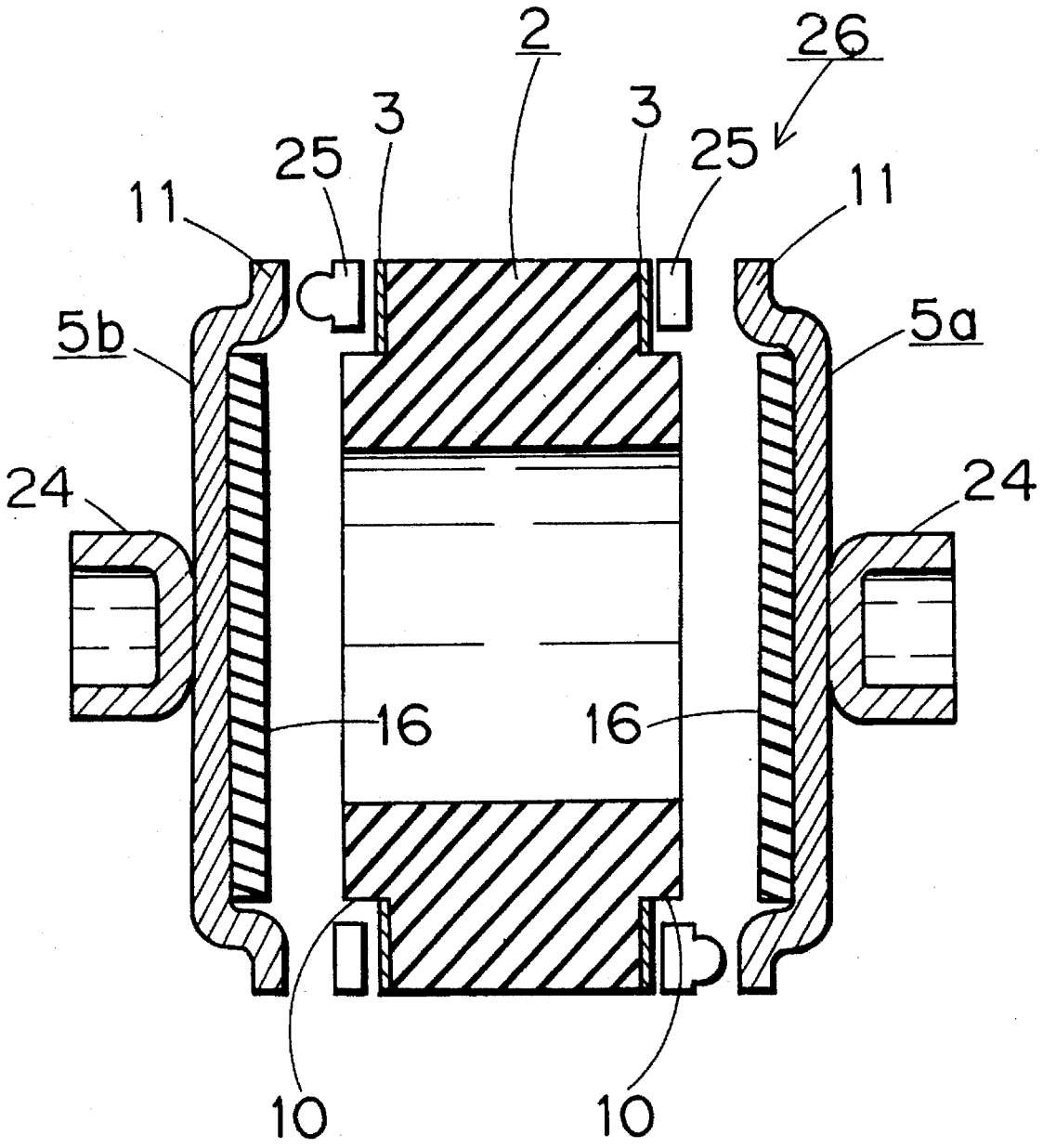
FIG. 10 is a sectional view of a yet further discharge tube showing a sixth preferred embodiment of the present invention.
Figure 11:
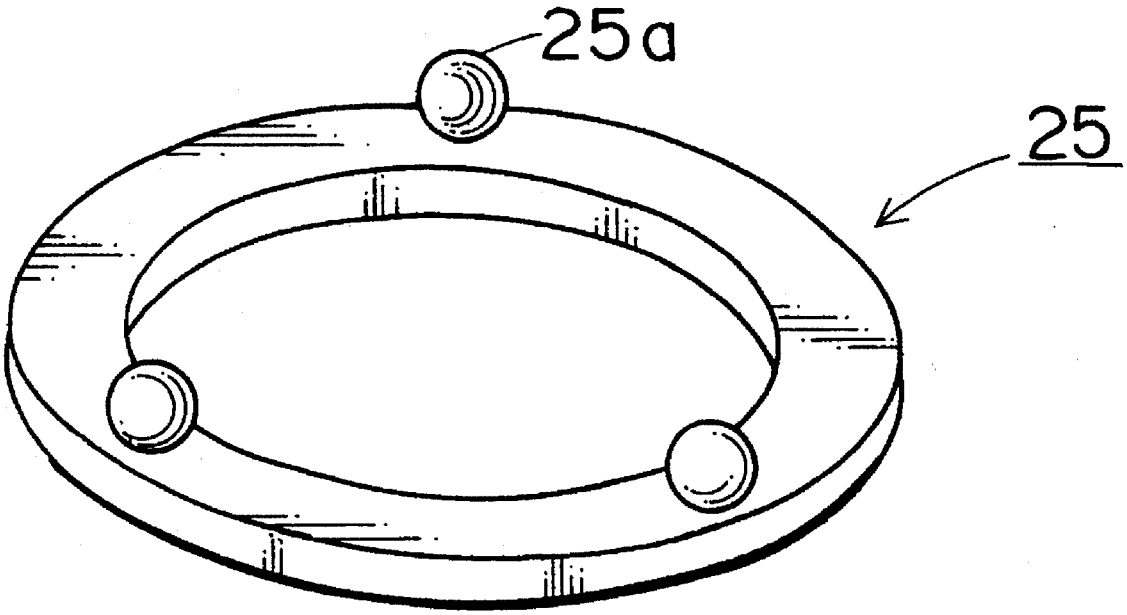
FIG. 11 is a perspective view of a solder material employed in the discharge tube shown in FIG. 10.
Figure 12:
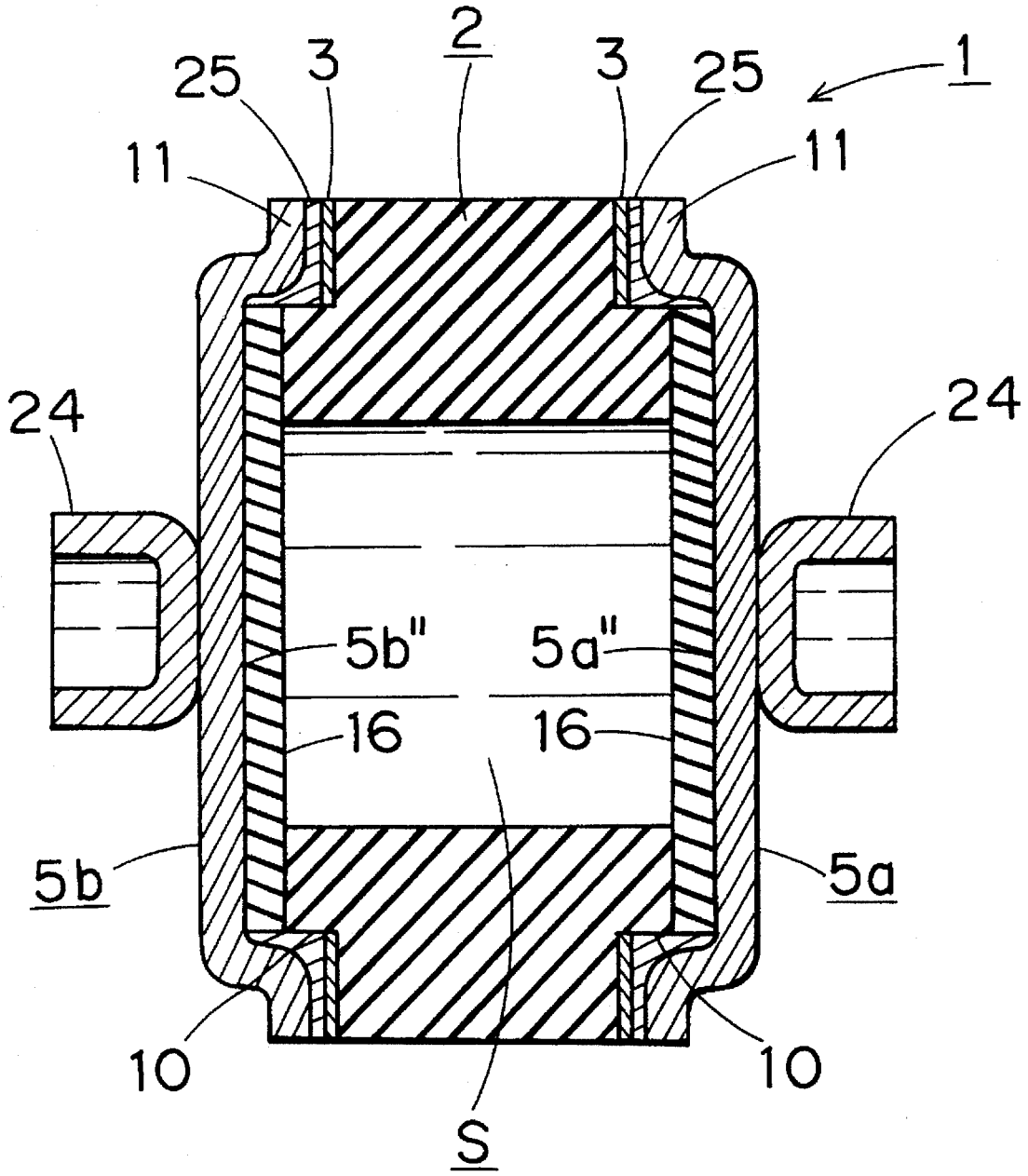
FIG. 12 is a sectional view of the discharge tube of FIG. 10 in an assembled form.

Referring now to FIGS. 10 to 12, there is shown a discharge tube according to a yet further embodiment of the present invention. The discharge tube of the present embodiment is a modification to the discharge tube 1 shown in FIG. 4 in that it is assembled in a procedure similar to that of the discharge tube shown in FIGS. 7 to 9 and discharge gas is enclosed in the discharge tube without using an enclosure pipe. Here, since the procedure is the same as that described above, it is omitted herein to avoid redundancy.

Accordingly, also with the discharge tube of the present embodiment, similar effects to those of the embodiments described above can be obtained, and the discharge tube 1 which assures stabilized discharge can be manufactured very readily.

It is to be noted that the present invention is not limited to the specific embodiments described above and various modifications can be made to them. While, in the embodiments shown in FIGS. 1 to 6, a connecting portion for establishing communication between the discharge tube 1 and the outside is not shown, such connecting portions as shown in FIGS. 7 to 12 may be provided suitably, or the enclosure pipe 6 may be used also as a connecting portion for establishing communication with the outside.

Having now fully described the invention, it will be apparent to one of ordinary skill in the art that many changes and modifications can be made thereto without departing from the spirit and scope of the invention as set forth herein.

What is claimed is:

1. A discharge tube, comprising:

a cylindrical envelope made of an insulating substance;

discharge gas enclosed in a cavity of said envelope;

a pair of discharge electrodes disposed in an opposing relationship to each other at the opposite ends of said envelope, said discharge electrodes being formed as parallel plate electrodes wherein faces thereof facing the inside of said envelope extend flat and in parallel to each other; and a pair of conductive layers formed on said envelope in an opposing relationship to and electrically connected to said discharge electrodes, one of said conductive layers being opposed with at least part of the other conductive layer and with a portion of said envelope interposed therebetween, said conductive layers forming an electric field in the envelope approximating a uniform electric field formed in the cavity of said envelope.

2. A discharge tube as claimed in claim 1, wherein said discharge electrodes are sealed to said envelope at said conductive layers.

3. A discharge tube comprising:

a cylindrical envelope made of an insulating substance;

discharge gas enclosed in said envelope;

a pair of discharge electrodes disposed in an opposing relationship to each other at the opposite ends of said envelope, said discharge electrodes being formed as parallel plate electrodes wherein faces thereof facing the inside of said envelope extend flat and in parallel to each other;

a pair of conductive layers formed on said envelope in an opposing relationship to and electrically connected to said discharge electrodes, one of said conductive layers being opposed at least part thereof with the other conductive layer with a portion of said envelope interposed therebetween; and a sputtering preventing member disposed on one of said discharge electrodes which serves as an anode in such a manner as to cover over a central portion of a surface of the one discharge electrode opposing to the other discharge electrode.

4. A discharge tube comprising:

a cylindrical envelope made of an insulating substance;

discharge gas enclosed in said envelope;

a pair of discharge electrodes disposed in an opposing relationship to each other at the opposite ends of said envelope, said discharge electrodes being formed as parallel plate electrodes wherein faces thereof facing the inside of said envelope extend flat and in parallel to each other;

a pair of conductive layers formed on said envelope in an opposing relationship to and electrically connected to said discharge electrodes, one of said conductive layers being opposed at least part thereof with the other conductive layer with a portion of said envelope interposed therebetween; and an external creeping discharge preventing member made of an insulating substance and disposed such that it covers over said conductive layers.

5. A discharge tube, comprising:

a cylindrical envelope made of an insulating substance;

discharge gas enclosed in said envelope;

first and second discharge electrodes disposed in an opposing relationship to each other at opposite ends of said envelope; and first and second conductive layers corresponding to said first and second discharge electrodes, respectively, formed on an outer end face of said envelope, wherein a distance between the first and second conductive layers is less than a distance between the first and second discharge electrodes, and wherein said conductive layers are electrically connected to the respective corresponding discharge electrodes.

6. A discharge tube as claimed in claim 5, further comprising a projecting element formed at each end of said envelope and extending radially inwardly farther than the inner wall face of said envelope.

7. A discharge tube as claimed in claim 6, wherein an inner end face of said projecting element is located nearer than the inner end face of the corresponding discharge electrode to the companion discharge electrode.

8. A discharge tube as claimed in claim 6, wherein said projecting element has a hole formed at a central portion thereof, and further comprising a sputtering preventing member disposed on one of said discharge electrodes which serves as an anode in such a manner as to cover over a central portion of a surface of the one discharge electrode opposing to the other discharge electrode, said sputtering preventing member being fitted in said hole of said projecting element.

9. A discharge tube as claimed in claim 5, wherein said discharge electrodes are sealed to said envelope at said conductive layers.

10. A discharge tube as claimed in claim 5, further comprising a sputtering preventing member disposed on one of said discharge electrodes which serves as an anode in such a manner as to cover over a central portion of a surface of the one discharge electrode opposing to the other discharge electrode.

11. A discharge tube as claimed in claim 5, further comprising an external creeping discharge preventing member made of an insulating substance and disposed such that it covers over said conductive layers.

12. A discharge tube as claimed in claim 5, wherein each of said conductive layers is sealed to a corresponding one of said discharge electrodes by way of a solder material.

* * * * *

UNITED STATES PATENT AND TRADEMARK OFFICE

CERTIFICATE OF CORRECTION

PATENT NO. : 5,491,381

DATED : February 13, 1996

INVENTOR(S) : Gijun IDEI et al.

It is certified that error appears in the above-indentified patent and that said Letters Patent is hereby corrected as shown below:

On the title page,

Item [54], title, after "DISCHARGE TUBE" insert --HAVING CYLINDRICAL TUBE--.

Item [57], abstract, line 7, delete "the" (third occurrence).

Signed and Sealed this

Third Day of December, 1996

Bruce Lehman

*Attest:*

BRUCE LEHMAN

*Attesting Officer*

*Commissioner of Patents and Trademarks*